US008805693B2

(12) United States Patent
Lindahl et al.

(10) Patent No.: US 8,805,693 B2
(45) Date of Patent: Aug. 12, 2014

(54) EFFICIENT BEAT-MATCHED CROSSFADING

(75) Inventors: Aram Lindahl, Menlo Park, CA (US); Richard Michael Powell, Mountain View, CA (US)

(73) Assignee: Apple Inc., Cupertino, CA (US)

( * ) Notice: Subject to any disclaimer, the term of this patent is extended or adjusted under 35 U.S.C. 154(b) by 453 days.

(21) Appl. No.: 12/858,900

(22) Filed: Aug. 18, 2010

(65) Prior Publication Data

US 2012/0046954 A1 Feb. 23, 2012

(51) Int. Cl.
*G10L 19/00* (2013.01)

(52) U.S. Cl.
USPC ..... 704/500; 704/200; 704/200.1; 704/501

(58) Field of Classification Search
USPC ..... 704/500–504
See application file for complete search history.

(56) References Cited

U.S. PATENT DOCUMENTS

| | | | | |
|---|---|---|---|---|
| 7,302,396 | B1 | 11/2007 | Cooke | |
| 7,425,674 | B2 | 9/2008 | Moulios et al. | |
| 7,678,983 | B2 * | 3/2010 | Komori et al. | 84/600 |
| 2002/0133357 | A1 * | 9/2002 | McLean | 704/500 |
| 2002/0178012 | A1 * | 11/2002 | Wang et al. | 704/503 |
| 2004/0254660 | A1 | 12/2004 | Seefeldt | |
| 2007/0291958 | A1 * | 12/2007 | Jehan | 381/103 |
| 2009/0178542 | A1 | 7/2009 | Jochelson et al. | |
| 2010/0063825 | A1 | 3/2010 | Williams et al. | |

* cited by examiner

*Primary Examiner* — Douglas Godbold
(74) *Attorney, Agent, or Firm* — Blakely, Sokoloff, Taylor & Zafman LLP

(57) ABSTRACT

Methods and devices to enable efficient beat-matched, DJ-style crossfading are provided. For example, such a method may involve determining beat locations of a first audio stream and a second audio stream and crossfading the first audio stream and the second audio stream such that the beat locations of the first audio stream are substantially aligned with the beat locations of the second audio stream. The beat locations of the first audio stream or the second audio stream may be determined based at least in part on an analysis of frequency data unpacked from one or more compressed audio files.

17 Claims, 11 Drawing Sheets

EFFICIENT BEAT-MATCHED CROSSFADING

BACKGROUND

The present disclosure relates generally to audio processing in electronic devices and, more particularly, to efficient detection of beats in an audio file.

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Portable electronic devices are increasingly capable of performing a range of audio operations in addition to simply playing back streams of audio. One such audio operation, crossfading between songs, may take place as one audio stream ends and another begins for a seamless transition between the two audio streams. Typically, an electronic device may crossfade between two audio streams by mixing the two streams over a span of time (e.g., 1-10 seconds), during which the volume level of the first audio stream is slowly decreased while the volume level of the second audio stream is slowly increased.

Some electronic devices may perform a beat-matched, DJ-style crossfade by detecting and matching beats in the audio streams. Conventional techniques for such beat detection in electronic devices may involve complex, resource-intensive processes. These techniques may involve, for example, analyzing a decoded audio stream for certain information indicative of a beat (e.g., energy flux). While such techniques may be accurate, they may consume significant resources and therefore may be unfit for portable electronic devices.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

Embodiments of the present disclosure relate to methods and devices for efficient beat-matched, DJ-style crossfading between audio streams. For example, such a method may involve determining beat locations of a first audio stream and a second audio stream and crossfading the first audio stream and the second audio stream such that the beat locations of the first audio stream are substantially aligned with the beat locations of the second audio stream. The beat locations of the first audio stream or the second audio stream may be determined based at least in part on an analysis of frequency data unpacked from one or more compressed audio files.

BRIEF DESCRIPTION OF THE DRAWINGS

Various aspects of this disclosure may be better understood upon reading the following detailed description and upon reference to the drawings in which.

DETAILED DESCRIPTION OF SPECIFIC EMBODIMENTS

Figure 1:
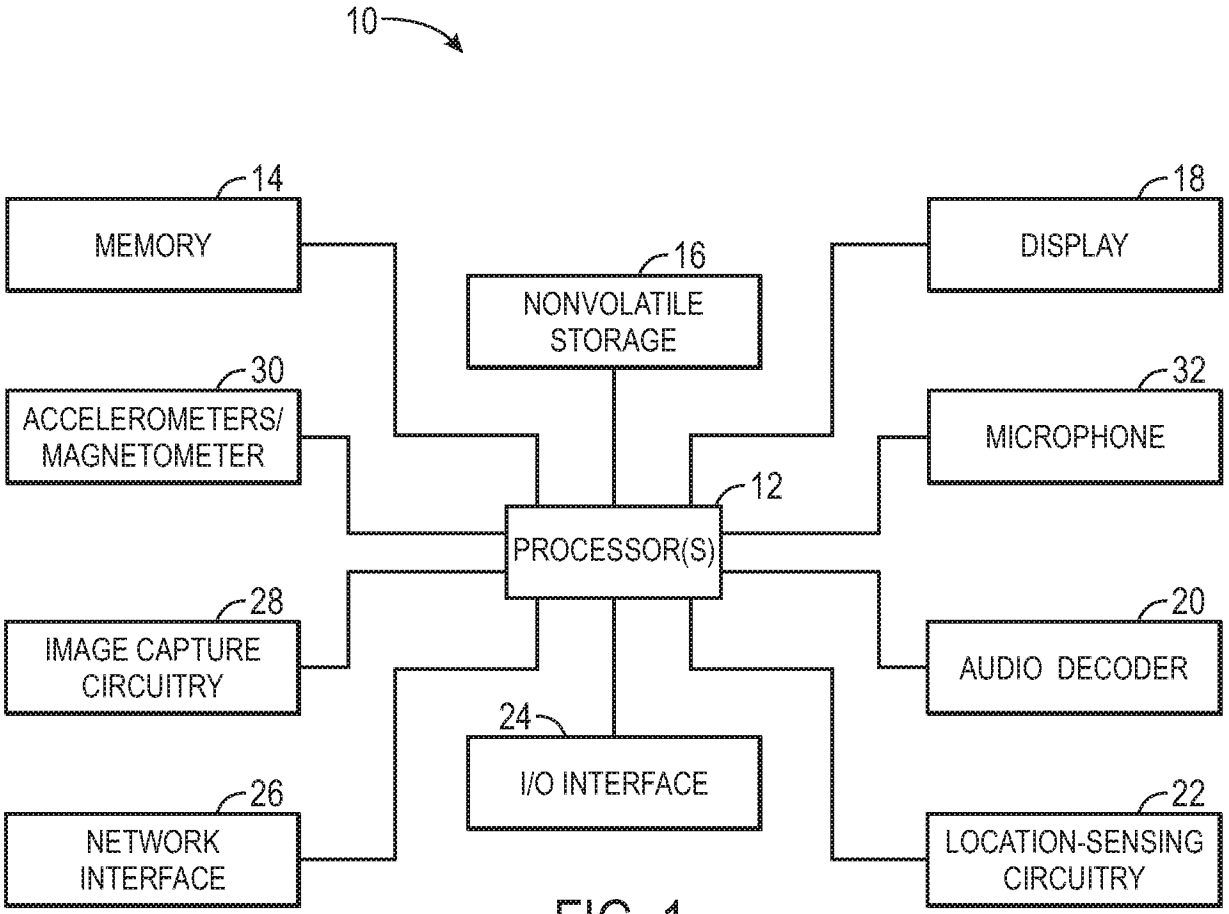
FIG. 1 is a block diagram of an electronic device capable of performing techniques disclosed herein, in accordance with an embodiment.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Present embodiments relate to techniques for beat detection in audio files, which may allow for a beat-matched, DJ-style crossfade operation. Instead of analyzing a fully decoded audio stream to detect locations of beats (which may consume significant resources), present embodiments may involve analyzing a partially decoded audio file to detect such beat locations. Specifically, a compressed audio file representing an audio file may be unpacked (e.g., decomposed into constituent frames of frequency data). After unpacking the compressed audio file into its constituent frames of frequency data, an embodiment of an electronic device may analyze the frames to detect which frames represent likely beat locations in the audio stream the compressed audio file represents. Such likely beat locations may be identified, for example, by analyzing a series of frames of frequency data for certain changes in frequency (a spectral analysis) or for patterns occurring in the sizes of time windows associated with the frames (a time window analysis).

Having identified likely beat locations in certain of the frames of frequency data, the electronic device may extrapolate likely beat locations elsewhere in the audio stream. In some embodiments, these extrapolated likely beat locations may be confirmed by skipping ahead to another series of frames of frequency data of the audio file where a beat has been extrapolated to be located. The electronic device may test whether a likely beat location occurs using, for example, a spectral analysis or a time window analysis. Beat location information associated with the audio file subsequently may be stored in a database or in metadata associated with the audio file.

Having determined beat locations for the audio stream, the electronic device may perform a beat-matched, DJ-style crossfading operation when the audio stream starts to play. Specifically, the electronic device may perform any suitable crossfading technique, aligning the beats of the starting and ending audio streams by aligning the detected likely beat locations and/or scaling the audio streams. As one audio stream ends and the next begins, the two streams may transition seamlessly, DJ-style.

Figure 2:
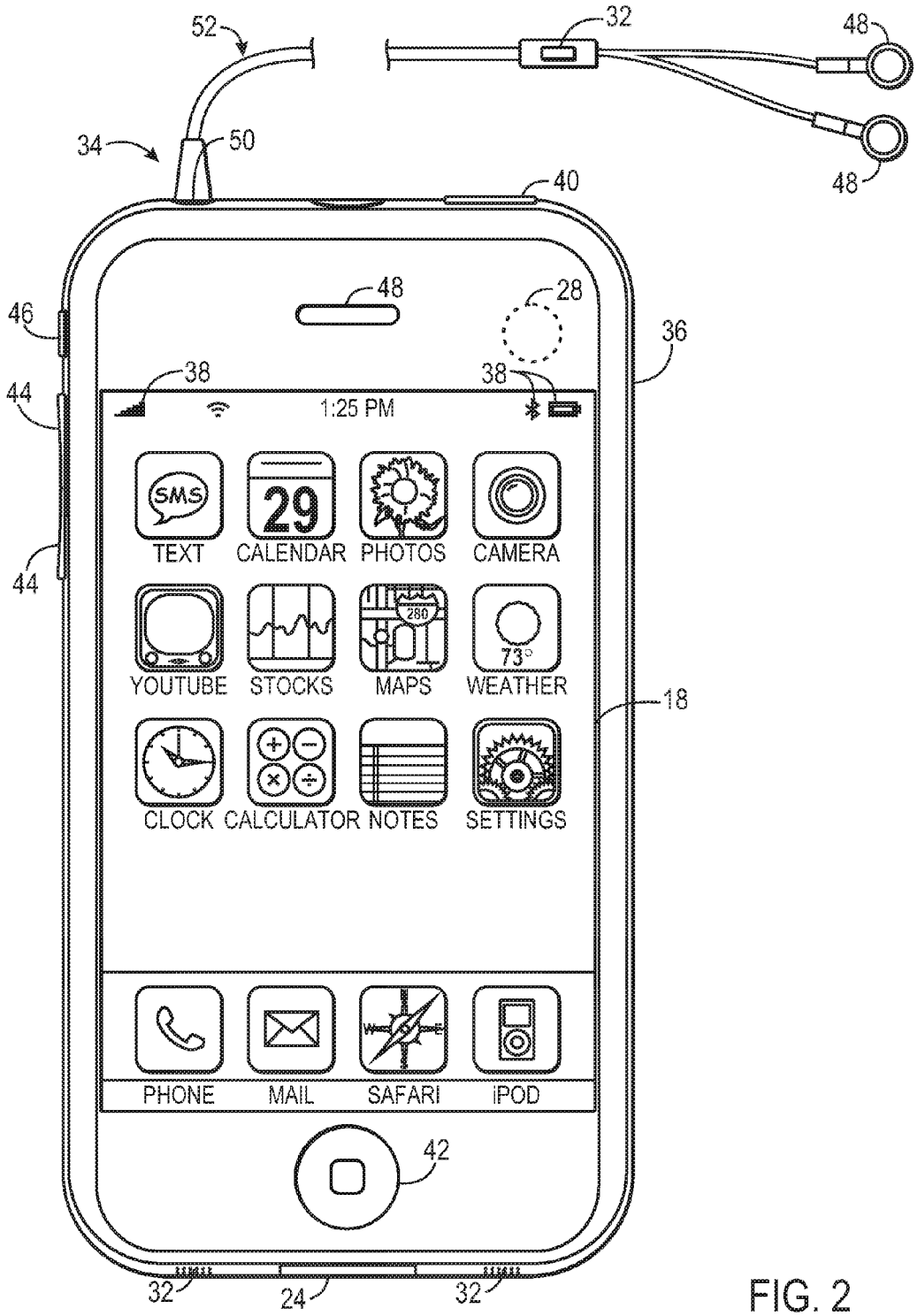
FIG. 2 is a perspective view of the electronic device of FIG. 1 in the form of a handheld device, in accordance with an embodiment.

With the foregoing in mind, a general description of suitable electronic devices for performing the presently disclosed techniques is provided below. In particular, FIG. 1 is a block diagram depicting various components that may be present in an electronic device suitable for use with the present techniques. FIG. 2 represents one example of a suitable electronic device, which may be, as illustrated, a handheld electronic device having data processing circuitry capable of unpacking a compressed audio file and analyzing the unpacked data for likely beat locations.

Turning first to FIG. 1, an electronic device 10 for performing the presently disclosed techniques may include, among other things, one or more processor(s) 12, memory 14, nonvolatile storage 16, a display 18, an audio decoder 20, location-sensing circuitry 22, an input/output (I/O) interface 24, network interfaces 26, image capture circuitry 28, accelerometers/magnetometer 30, and a microphone 32. The various functional blocks shown in FIG. 1 may include hardware elements (including circuitry), software elements (including computer code stored on a computer-readable medium) or a combination of both hardware and software elements. It should further be noted that FIG. 1 is merely one example of a particular implementation and is intended to illustrate the types of components that may be present in electronic device 10.

By way of example, the electronic device 10 may represent a block diagram of the handheld device depicted in FIG. 2 or similar devices having data processing circuitry capable of unpacking a compressed audio file and analyzing the unpacked data for likely beat locations. It should be noted that the data processing circuitry may be embodied wholly or in part as software, firmware, hardware or any combination thereof. Furthermore the data processing circuitry may be a single contained processing module or may be incorporated wholly or partially within any of the other elements within electronic device 10. The data processing circuitry may also be partially embodied within electronic device 10 and partially embodied within another electronic device wired or wirelessly connected to device 10.

In the electronic device 10 of FIG. 1, the processor(s) 12 and/or other data processing circuitry may be operably coupled with the memory 14 and the nonvolatile storage 16 to perform various algorithms for carrying out the presently disclosed techniques. Such programs or instructions executed by the processor(s) 12 may be stored in any suitable article of manufacture that includes one or more tangible, computer-readable media at least collectively storing the instructions or routines, such as the memory 14 and the nonvolatile storage 16. Also, programs (e.g., an operating system) encoded on such a computer program product may also include instructions that may be executed by the processor(s) 12 to enable the electronic device 10 to provide various functionalities, including those described herein. The display 18 may be a touch-screen display, which may enable users to interact with a user interface of the electronic device 10.

The audio decoder 20 may efficiently decode compressed audio files (e.g., AAC files, MP3 files, WMA files, and so forth), into a digital audio stream that can be played back to the user of the electronic device 10. While the audio decoder 20 is decoding one audio file for playback, other data processing circuitry (e.g., the processor(s) 12) may detect likely beat locations in the audio file queued to be played next. The transition from playback of the first audio file to the next audio file may be facilitated by the detected beats, allowing for a beat-matched, DJ-style crossfade operation.

The location-sensing circuitry 22 may represent device capabilities for determining the relative or absolute location of electronic device 10. By way of example, the location-sensing circuitry 22 may represent Global Positioning System (GPS) circuitry, algorithms for estimating location based on proximate wireless networks, such as local Wi-Fi networks, and so forth. The I/O interface 24 may enable electronic device 10 to interface with various other electronic devices, as may the network interfaces 26. The network interfaces 26 may include, for example, interfaces for a personal area network (PAN), such as a Bluetooth network, for a local area network (LAN), such as an 802.11x Wi-Fi network, and/or for a wide area network (WAN), such as a 3G cellular network.

Through the network interfaces 26, the electronic device 10 may interface with a wireless headset that includes a microphone 32. The image capture circuitry 28 may enable image and/or video capture, and the accelerometers/magnetometer 30 may observe the movement and/or a relative orientation of the electronic device 10. When employed in connection with a voice-related feature of the electronic device 10, such as a telephone feature or a voice recognition feature, the microphone 32 may obtain an audio signal of a user's voice.

FIG. 2 depicts a handheld device 34, which represents one embodiment of the electronic device 10. The handheld device 34 may represent, for example, a portable phone, a media player, a personal data organizer, a handheld game platform, or any combination of such devices. By way of example, the handheld device 34 may be a model of an iPod® or iPhone® available from Apple Inc. of Cupertino, Calif. In other embodiments, the handheld device 34 instead may be a tablet computing device, such as a model of an iPad® also available from Apple Inc. of Cupertino, Calif.

The handheld device 34 may include an enclosure 36 to protect interior components from physical damage and to shield them from electromagnetic interference. The enclosure 36 may surround the display 18, which may display indicator icons 38. The indicator icons 38 may indicate, among other things, a cellular signal strength, Bluetooth connection, and/or battery life. The I/O interfaces 24 may open through the enclosure 36 and may include, for example, a proprietary I/O port from Apple Inc. to connect to external devices. As indicated in FIG. 2, the reverse side of the handheld device 34 may include the image capture circuitry 28.

User input structures 40, 42, 44, and 46, in combination with the display 18, may allow a user to control the handheld device 34. For example, the input structure 40 may activate or deactivate the handheld device 34, the input structure 42 may navigate user interface 20 to a home screen, a user-configurable application screen, and/or activate a voice-recognition feature of the handheld device 34, the input structures 44 may provide volume control, and the input structure 46 may toggle between vibrate and ring modes. The microphone 32 may obtain a user's voice for various voice-related features, and a speaker 48 may enable audio playback and/or certain phone capabilities. Headphone input 50 may provide a connection to external speakers and/or headphones.

As illustrated in FIG. 2, a wired headset 52 may connect to the handheld device 34 via the headphone input 50. The wired headset 52 may include two speakers 48 and a microphone 32. The microphone 32 may enable a user to speak into the handheld device 34 in the same manner as the microphones 32 located on the handheld device 34.

Audio files played by the handheld device 34 may be played back on the speakers 48. In accordance with certain embodiments, when multiple audio streams are played in succession, the handheld device 34 may perform a beat-matched, DJ-style crossfade between the audio streams. Since the handheld device 34 may detect the beat locations in the audio files associated with the streams without using excessive resources, the battery life of the handheld device 34 may not suffer despite this functionality.

Figure 3:
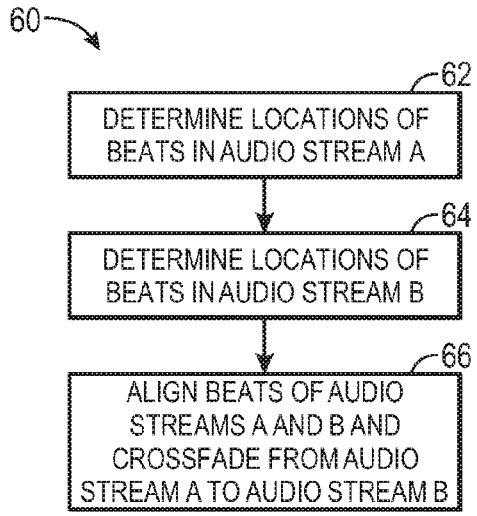
FIG. 3 is a flowchart describing an embodiment of a method for performing a DJ-style crossfading operation with beat-matching, in accordance with an embodiment.

Such a beat-matched, DJ-style crossfade generally may take place between two audio streams (e.g., audio stream A and audio stream B) as shown by a flowchart 60 of FIG. 3. The flowchart 60 may begin when an electronic device 10, such as the handheld device 34, determines the likely locations of beats in audio stream A (block 62) and the likely locations of beats in audio stream B (block 64). The likely beat locations in at least one of the audio stream A or B may determined according to the efficient beat detection techniques discussed in greater detail below and may be stored in a beat database located on the electronic device 10. In some embodiments, the determination of beat locations of the audio streams may take place while another audio stream is playing. For example, the electronic device 10 may be playing audio stream A while determining the likely beat locations in audio stream B. As shown in the flowchart 60 of FIG. 3, when audio stream A ends and audio stream B begins, the electronic device 10 may align the beats of the two audio streams and crossfade between them (block 66).

Figure 4:
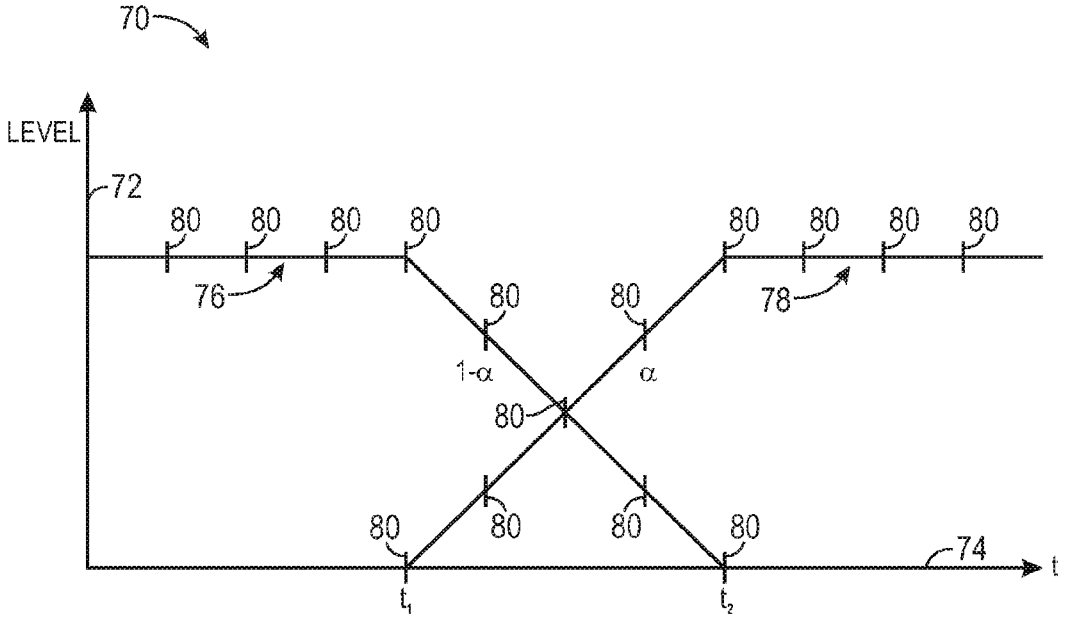
FIG. 4 is a schematic diagram of two audio streams during the crossfading operation described in FIG. 3, in accordance with an embodiment.

A plot 70 of FIG. 4 represents one manner in which crossfading may occur between two audio streams A and B. In the plot 70, an ordinate 72 represents relative volume level and/or power level (Level) and an abscissa 74 represents relative time (t). Curves 76 and 78 respectively represent audio streams A and B. Likely beats 80 of both audio stream A (curve 76) and audio stream B (curve 78) generally occur at approximately the same time during the crossfade operation illustrated by plot 70.

At the start of the plot 70, audio stream A (curve 76) may be the sole audio stream being output by the electronic device 10. Before audio stream A (curve 76) ends at time t2, the electronic device 10 may begin to decode and/or mix audio stream B (curve 78) at time t1. The crossfading of audio streams A (curve 76) and B (curve 78) may take place between times t1 and t2, during which audio stream B (curve 78) may be gradually increased at a relative level coefficient $\alpha$ and audio stream A (curve 76) may be gradually decreased at a relative level coefficient $1-\alpha$. It should be understood that the precise coefficients $\alpha$ and/or $1-\alpha$ employed during the crossfading operation may vary and, accordingly, need not be linear or symmetrical. Beyond time t2, the electronic device 10 may remain decoding and/or outputting only audio stream B until crossfading to the next audio stream in the same or similar manner.

To ensure that the beats 80 of the audio stream A (curve 76) and audio stream B (curve 78) are aligned during crossfading, the electronic device 10 may scale audio stream A (curve 76) or audio stream B (curve 78) in any suitable manner. Additionally or alternatively, only certain of the beats 80 may be aligned, such as a beat 80 most centrally located in the crossfade operation, to create the perception of beat alignment.

Figure 5:
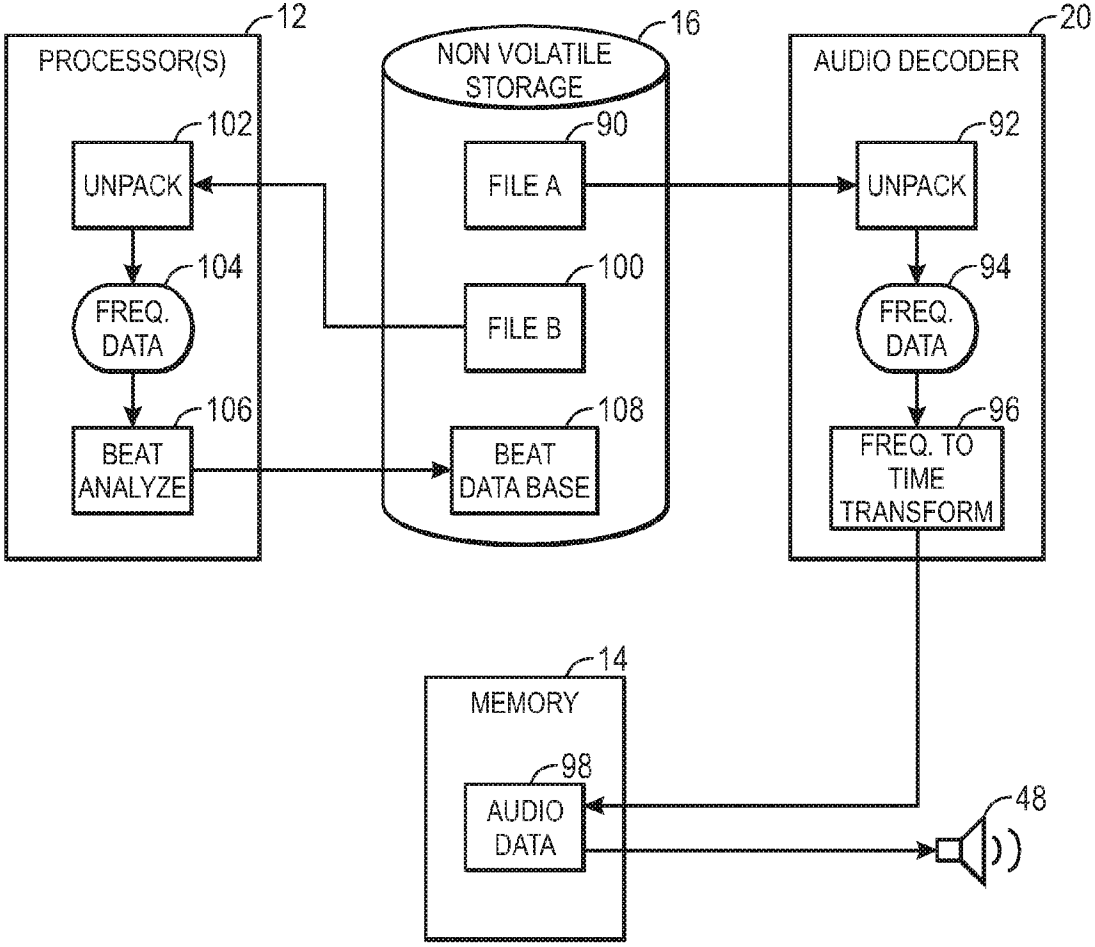
FIG. 5 is a schematic block diagram representing a manner in which the electronic device of FIG. 1 may decode and detect beats in audio streams, in accordance with an embodiment.

At least the beats 80 of audio stream A (curve 76) or audio stream B (curve 78) may be detected by the electronic device according to the present disclosure. FIG. 5 is a block diagram representation of certain elements of the electronic device 10 that may perform such beat detection techniques. As shown in FIG. 5, nonvolatile storage 16 may include a compressed audio file 90 (file A), which may be, for example, an AAC file, an MP3 file, a WMA file, or another such file that represents a first audio stream (audio stream A). The compressed audio file 90 may be unpacked by an unpacking block 92 within the audio decoder 20 into its constituent frequency data 94. This frequency data 94 may represent a series of frames or time windows of audio information in the frequency domain, which may be used to reconstruct the audio stream A in the time domain via a frequency-to-time transform block 96 of the audio decoder 20. The resulting decoded audio stream A represented by with the compressed audio file 90 may be stored in the memory 14 as audio data 98. This audio data 98 may be streamed to a speaker 48 of the electronic device 10.

A compressed audio file 100 (file B) that represents a second audio stream (audio stream B) may be queued for playback by the electronic device 10 after the compressed audio file 90. At any suitable time, including while the audio decoder 20 is actively decoding the compressed audio file 90 into audio stream A, certain data processing circuitry of the electronic device 10 may analyze the compressed audio file 100 for likely beat locations in audio stream B. Performed in certain embodiments as a background task running on the processor(s) 12, the audio file 100 may be only partially decoded before being analyzed. In other embodiments, partial decoding and/or analysis may take place in any suitable data processing circuitry of the electronic device 10.

The compressed audio file 100 may be partially decoded by an unpacking block 102, which may unpack the frequency data 104 from the audio file 100. This frequency data 104 may represent a series of frames or time windows of audio information in the frequency domain. A beat-analyzing block 106 may analyze the frequency data 104 to determine likely locations of beats in the compressed audio file 100 using any suitable manner, many of which are discussed in greater detail below. For example, the beat-analyzing block 106 may analyze certain frequencies of interest over a series of frames of the frequency data 104 for periodic changes indicative of beats (a spectral analysis) or may analyze a series of frames of the frequency data 104 for patterns occurring in the sizes of time windows associated with the frames (a time window analysis).

The likely location of the beats associated with the compressed audio file 100, as determined by the beat-analyzing block 106, may be stored in a beat database 108 in the nonvolatile storage 16. Additionally or alternatively, the determined location of beats in the audio file 100 may be stored as metadata associated with the audio file 100. Moreover, in certain embodiments, the likely beat locations stored in the beat database 108 may be uploaded to an online database of audio file beat location information hosted, for example, by iTunes® by Apple Inc. The online database of audio file beat location information uploaded by other electronic devices 10 may be used to verify or refine the beat location information stored in the beat database 108.

After the audio decoder 20 has finished decoding the compressed audio file 90 (FILE A) and stored the resulting audio stream A in the audio data 98 in the memory 14, the audio decoder 20 may begin to decode the compressed audio file 100 (FILE B). In some embodiments, the audio decoder 20 may decode the compressed audio file 100 in the same manner as the compressed audio file 90 is decoded as shown in FIG. 5. That is, the audio decoder 20 may unpack the compressed audio file 100 in the unpacking block 92 to obtain frequency data 94 (which would be the same as the frequency data 104). The frequency data 94 then may be decoded in the frequency-to-time transformation block 96.

Figure 6:
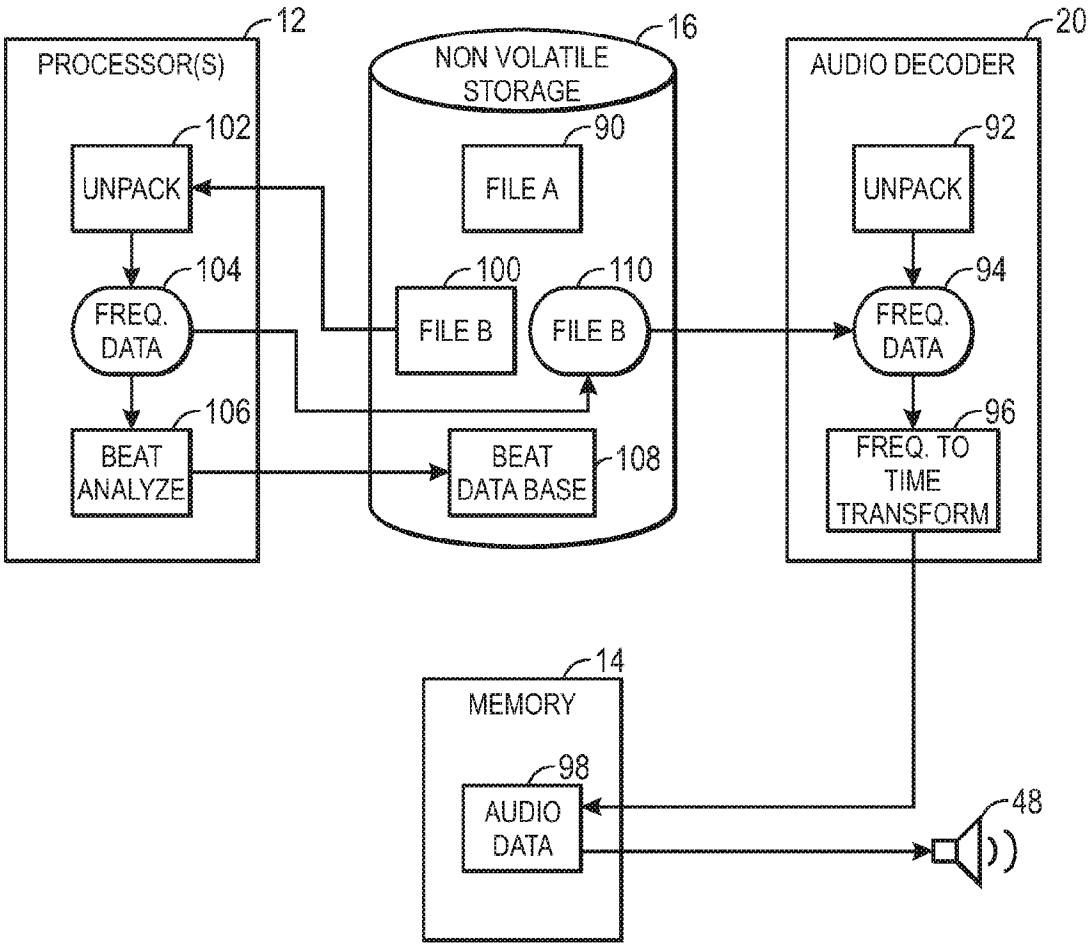
FIG. 6 is a schematic block diagram representing another manner in which the electronic device of FIG. 1 may decode and detect beats in audio streams, in accordance with an embodiment.

In certain other embodiments, as shown by FIG. 6, the audio decoder 20 may decode the compressed audio file 100 without unpacking it. Specifically, it may be noted that software operating on the processor(s) 12 may have already unpacked the compressed audio file 100 to obtain its constituent frequency data 104. This frequency data 104 may be stored in the nonvolatile storage 16 as file B frequency data 110. Rather than replicate the unpacking that has already taken place in the unpacking block 102, the audio decoder 20 may simply finish decoding the frequency data 110 in the frequency-to-time transformation block 96, saving additional resources.

Figure 7:
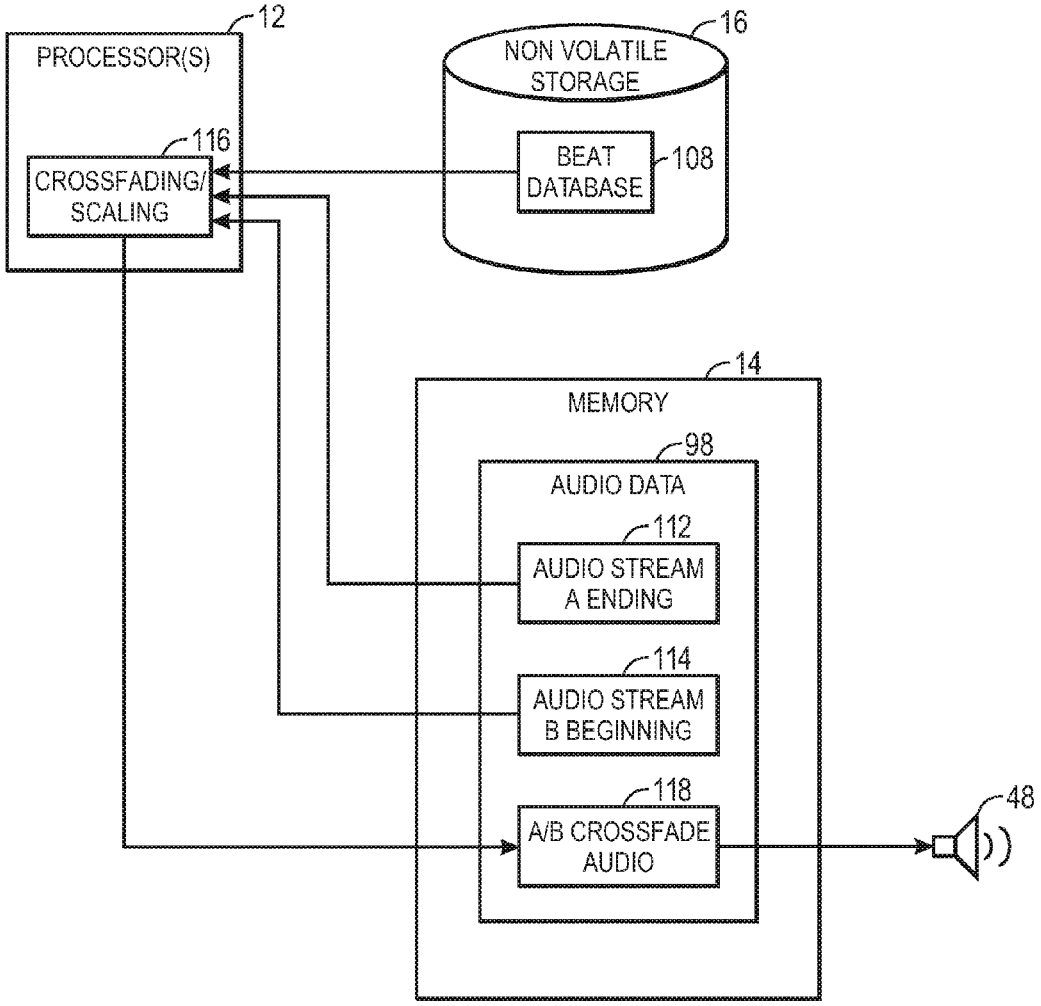
FIG. 7 is a schematic block diagram representing a manner in which the electronic device of FIG. 1 may perform a beat-matched crossfading operation, in accordance with an embodiment.

After at least the beginning of the compressed audio file 100 (file B) has been decoded and stored in the audio data 98 on the memory 14, the electronic device 10 may begin to perform a beat-matched, DJ-style crossfading operation. For example, as shown in FIG. 7, audio data 112 representing an ending of audio stream A and audio data 114 representing a beginning of audio stream B may be stored among the audio data 98 on the memory 14. A crossfading block 116, representing an algorithm executing on the processor(s) 12 may retrieve the audio data 112 and 114 and beat location information from the beat database 108. As should be appreciated, the beat location information stored in the beat database 108 may include not only the likely beat locations detected in the audio stream B (e.g., as shown by FIGS. 5 and 6), but also likely beat locations of the audio stream A. The likely beat locations of the audio stream A may have been previously detected in the same manner as audio stream B, or such likely beat locations may have been obtained by another technique or from an external source, such as an online beat detection database.

The crossfading block 116 may mix the audio data 112 and 114 such that a beat-matched crossfading operation takes place, for example, in the manner illustrated by the plot 70 of FIG. 4. That is, the crossfading block 116 may perform any suitable crossfading technique such that the beat location information associated with audio stream A aligns with that of the audio stream B. Such crossfading may involve aligning or scaling one or both of the audio streams A and B such that all or at least certain beats occur during the crossfading. Thus, as the audio stream A ends and the audio stream B begins, the transition between the two may be perceived to be seamless, with beats of one song transitioning into beats of the next.

Figure 8:
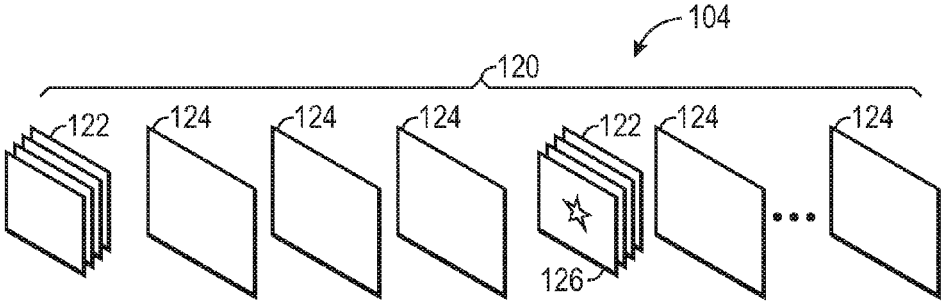
FIG. 8 is a schematic diagram of frequency data obtained by partially decoding a compressed audio file, in accordance with an embodiment.

As noted above, the beat-analyzing block 106 may detect beats in a compressed audio file in a variety of manners. Notably, these techniques may involve analyzing the partially decoded frequency data 104 rather than the fully decoded audio stream output by the audio decoder 20. As shown in FIG. 8, such frequency data 104 may be understood to represent a series of frames 120 or time windows of audio information in the frequency domain. Such frames 120 of frequency data 104 may represent frequencies present during certain slices or windows of time of the audio stream. Some time windows may be relatively short-term, as schematically represented by short-term time windows 122. Other time windows may be relatively long-term, as schematically represented by long-term time windows 124. The short-term time windows 122 may be used to better encode transients occurring in the audio stream that is compressed in the frequency data 104. That is, when a transient in an audio stream is encountered by an encoder encoding the audio stream, the encoder will typically switch from using the long-term time windows 124 to short-term time windows 122. As will be discussed in greater detail below, since the short-term time windows 122 generally occur when transients occur, and beats are one form of transients that appear in an audio stream, the occurrence of the short-term time windows 122 may suggest a likely beat location 126.

By way of example, in certain embodiments, the long-term time windows 124 may hold approximately 40 ms of audio information, while the small time slices 122 may represent transients and thus may contain approximately ⅛ that, or approximately 5 ms of audio information. For some types of compressed audio files (e.g., AAC), the short-term time windows 122 may occur in groups of 8, representing approximately the same amount of time as 1 long-term time window 124. In other embodiments, the frames 120 of frequency data 104 may include more than two sizes of time windows, typically varying in size between long-term and short-term lengths of time.

Figure 9:
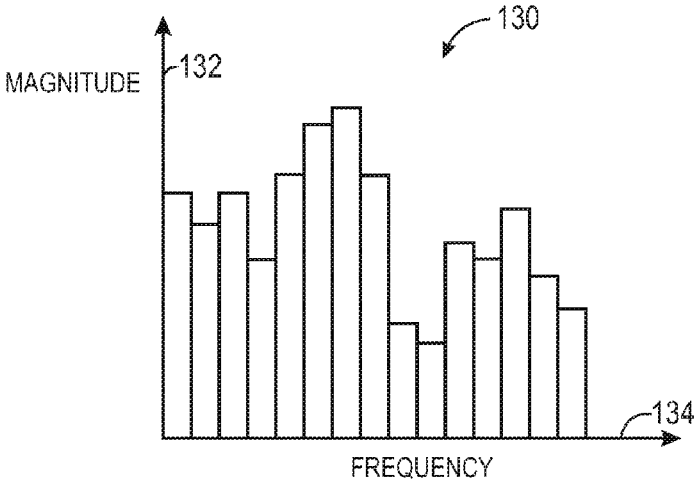
FIG. 9 is a spectral diagram modeling one frame of the frequency data of FIG. 8, in accordance with an embodiment.

Each of the frames 120 may represent specific frequency information for a given point in time, as represented schematically by a plot 130 of FIG. 9. An ordinate 132 of the plot 130 represents a magnitude or relative level of audio and an abscissa 134 represents certain discrete frequency values of the audio in a given frame 120. The frequency values along the abscissa 134 may be understood to increase from right to left, beginning with a low frequency (e.g., 20 Hz) at the origin of the plot 130 to a high frequency (e.g., 20 kHz). It should be understood that any suitable number of discrete frequency values may be present in each of the frames 120 of frequency data 104, and that the limited number of discrete frequency values of the plot 130 are shown for ease of explanation only.

Figure 10:
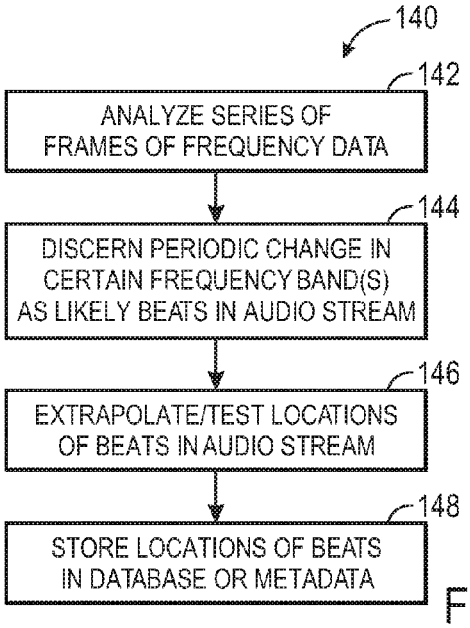
FIG. 10 is a flowchart describing an embodiment of a method for detecting beats using a spectral analysis of the frequency data of FIG. 8.

By analyzing a series of the frames 120, the beat-analyzing block 106 may determine when beats are likely to occur in the compressed audio file being analyzed. As noted above, the beat-analyzing block 106 may detect beats in a compressed audio file through a spectral analysis of a series of frames 120, a time window analysis, or a combination of both techniques. For example, as shown in FIG. 10, a flowchart 140 illustrates one manner of performing a spectral analysis. The flowchart 140 may begin when the beat-analyzing block 106 analyzes a series of frames 120 of frequency data 104 (block 142). In some embodiments, this series of frames 120 may be approximately 100 frames long, but in other embodiments the series of frames 120 also may be more or fewer. In general, the number of frames 120 analyzed for beats may be any number suitable to ascertain a beat pattern in the compressed audio file being analyzed.

In particular, the beat-analyzing block 106 may discern a periodic change occurring in certain frequency bands of the frames 120 of frequency data 104 (block 144). For example, the beat-analyzing block 106 may consider certain changes in a frequency band of interest, such as a bass frequency where beats may commonly be found. As should be appreciated, such a frequency band of interest may be any frequency in which a beat may be expected to occur, such as a frequency commonly associated with a precaution instrument. Note that, in this way, higher frequencies also may serve as frequencies of interest (e.g., cymbals or higher-frequency drums may provide beats in certain songs). These certain periodic changes in frequency over the series of frames 120 may represent beats, and thus the beat-analyzing block 106 may identify them as such.

Based on such detected likely beat locations, the beat-analyzing block 106 may extrapolate other likely beat locations in the compressed audio file beyond the analyzed series of frames 120 (block 146). Additionally, the beat-analyzing block 106 may perform one or more tests to verify that the extrapolated location of beats in the audio file appear to represent likely beat locations. By way of example, the beat-analyzing block 106 may analyze a smaller series of frames 120 in another location in the audio file where beats have been extrapolated and therefore are expected to be located. If the beats do not appear to be present among the expected frames 120, the beat-analyzing block 106 may reevaluate a new series of frames 120 to determine a new set of beat locations and re-extrapolate the beat locations, as discussed in greater detail below. After extrapolating and/or verifying the likely locations of beats in the compressed audio file, the beat-analyzing block 106 may cause these likely beat locations to be stored in the beat database 108 in nonvolatile storage 16 or otherwise to be associated with the metadata of the audio file (block 148) for later use in a beat-matched, DJ-style cross-fading operation.

Figure 11:
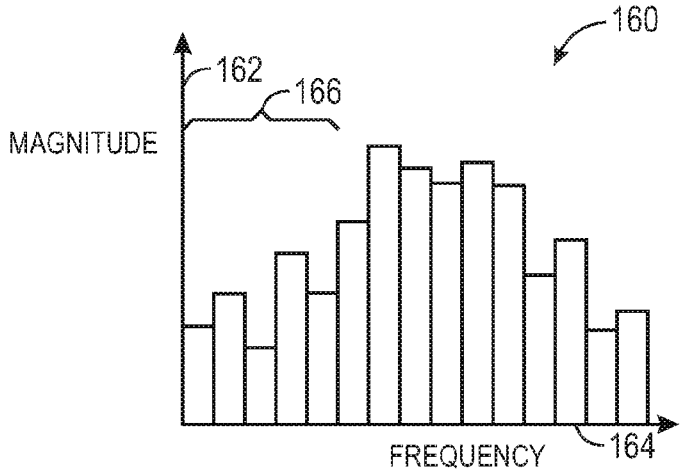
FIGS. 11-13 are spectral diagrams illustrating a manner of performing the spectral analysis of FIG. 10, in accordance with an embodiment.
Figure 12:
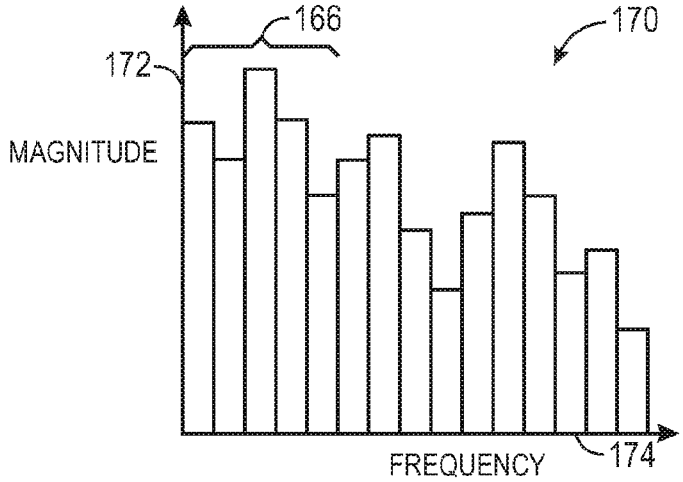
Figure 13:
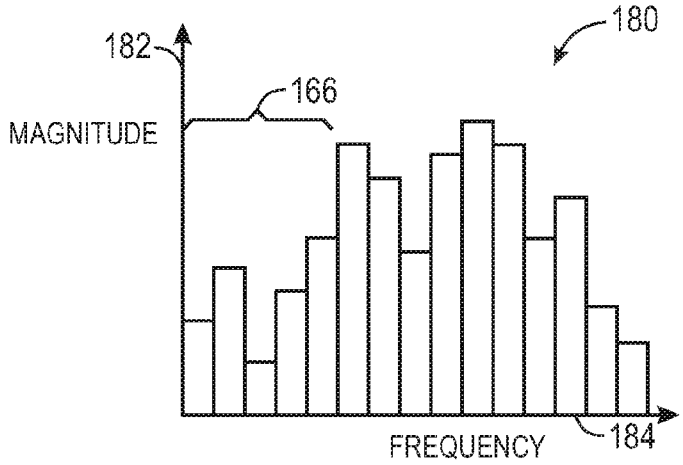

The spectral analysis discussed with reference to FIG. 10 may take place by analyzing a specific frequency of interest over several frames 120. FIGS. 11-13 schematically illustrate one embodiment in which beats may be represented among certain of the frames 120 of frequency data 104. Turning first to FIG. 11, a plot 160 represents a single frame 120 of frequency data 104. The plot 160 includes an ordinate 162 that represents a magnitude of each frequency and an abscissa 164 represents certain discrete frequencies. As should be understood, an actual frame 120 of frequency data 104 may include more or fewer discrete frequencies than are represented in the plot 160, which is intended to be schematic and is used for explanatory purposes only.

A frequency band of interest 166 represents a specific band of frequencies being analyzed by the beat-analyzing block 106 for certain changes occurring over the series of frames 120. In the plot 160, the frequency band of interest 166 is a band of frequencies in the bass range. However, it should be understood that in other embodiments the frequency band of interest 166 may represent another band of frequencies in the frame 120 of frequency data 104. Also, in some embodiments, the beat-analyzing block 106 may analyze more than one frequency band of interest 166. For example, one frequency band of interest 166 may be a bass frequency, while another frequency band of interest 166 may be a frequency band associated with other percussion instruments (e.g., cymbals or snare drums).

A plot 170 of FIG. 12 represents some frame 120 subsequent to the frame 120 represented by the plot 160 of FIG. 11. Like the plot 160, the plot 170 includes an ordinate 172 that represents a magnitude of each frequency and an abscissa 174 represents certain discrete frequencies. In the plot 170, the frequency band of interest 166 has increased in magnitude pointedly from the plot 160, and for explanatory purposes may be understood to have reached a peak, as will become apparent when compared to another frame 120 subsequent to the frames 120 of the plots 160 and 170.

Specifically, a plot 180 of FIG. 13 represents such a frame 120. Like the plots 160 and 170, the plot 180 includes an ordinate 182 that represents a magnitude of each frequency and an abscissa 184 represents certain discrete frequencies. In the plot 180, the frequency band of interest 166 has decreased from its peak in the plot 170. Since a beat is likely to occur when the bass frequencies increase to a peak, the beat-analyzing block 106 may determine that a beat is likely to occur during the frame 120 represented by the plot 170, when the frequency band of interest 166 reaches a peak.

Figure 14:
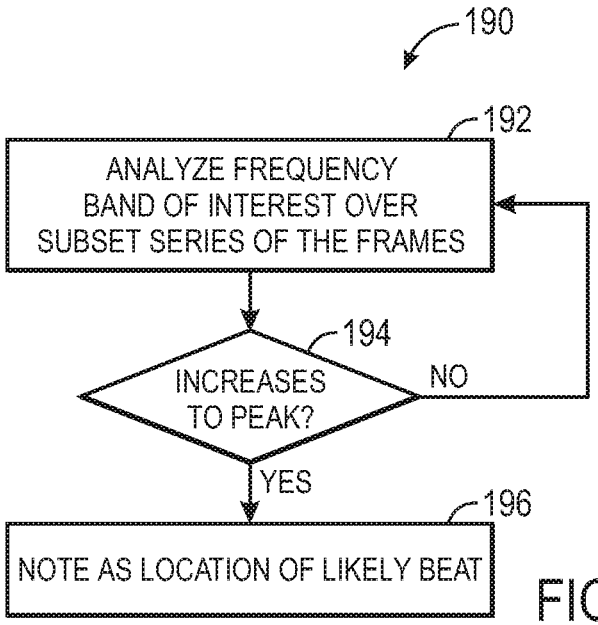
FIG. 14 is a flowchart describing an embodiment of a method for performing the spectral analysis of FIG. 10.

That is, the beat-analyzing block 106 may discern periodic changes in the frequency band of interest 166 by searching for such peaks in the series of frames 120 being analyzed, as shown by a flowchart 190 of FIG. 14. The flowchart 190 may begin when the beat-analyzing block 106 analyzes the frequency band of interest 166 over a subset of the series of frames (block 192). When the magnitude of frequency band of interest 166 increases to a peak (decision block 194), the beat analyzing block may note the frame 120 at which the frequency band of interest 166 reaches the peak as a likely location of a beat (block 196). As should be understood, the beat-analyzing block 106 may continue to analyze other subsets of the series of frames 120 for other locations that likely contain beats. From these likely beat locations discerned among the series of frames 120, the beat-analyzing block 106 may seek to establish a periodic pattern from which to extrapolate to other selections of the compressed audio file being analyzed.

Figure 15:
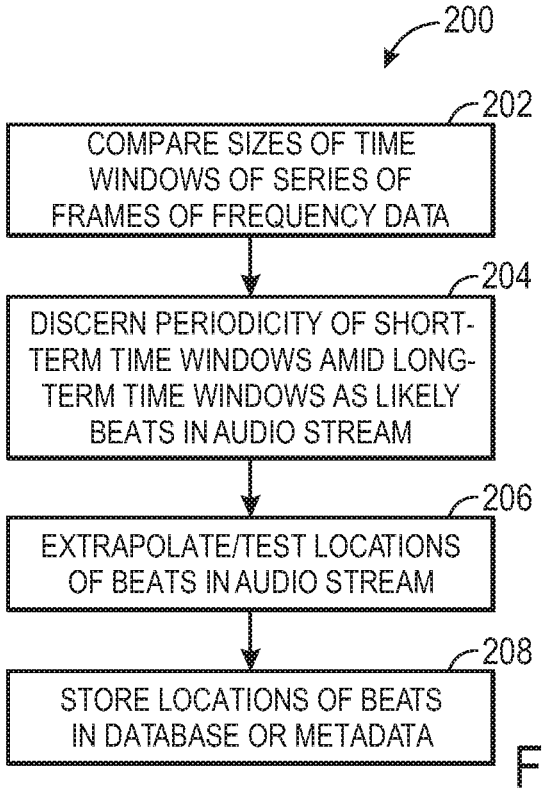
FIG. 15 is a flowchart describing an embodiment of a method for detecting beats by analyzing sizes of time windows of the frequency data of FIG. 8.

In addition, or alternatively, to such a spectral analysis, the beat-analyzing block 106 may detect beats in a compressed audio file through a time window analysis of a series of frames 120. For example, as shown in FIG. 15, a flowchart 200 illustrates one manner of performing a spectral analysis. The flowchart 200 may begin when the beat-analyzing block 106 analyzes a series of frames 120 of frequency data 104 (block 202). In some embodiments, this series of frames 120 may be approximately 100 frames long, but in other embodiments the series of frames 120 also may be more or fewer. In general, the number of frames 120 analyzed for beats may be any number suitable to ascertain a beat pattern in the compressed audio file being analyzed.

In particular, the beat-analyzing block 106 may discern a periodic change in the occurrence of short-term time windows 122, which represent relatively rapid changes in the compressed audio file being examined, and long-term time windows 124, which represent relatively slower changes in the compressed audio file being examined (block 204). Since beats in an audio stream may be relatively short-lived transient audio events, beats may be understood to generally occur during a period of short-term time windows 122. By analyzing the periodicity of the occurrence of certain time window sizes, likely locations of beats may be determined where groups of short-term time windows 122 repeat periodically. These certain periodic changes in time window size over the series of frames 120 may represent beats, and thus the beat-analyzing block 106 may identify them as such.

Based on such detected likely beat locations, the beat-analyzing block 106 may extrapolate other likely beat locations in the compressed audio file beyond the analyzed series of frames 120 (block 206). Additionally, the beat-analyzing block 106 may perform one or more tests to verify that the extrapolated location of beats in the audio file appear to represent likely beat locations. By way of example, the beat-analyzing block 106 may analyze a smaller series of frames 120 in another location in the audio file where beats have been extrapolated and therefore are expected to be located. If the beats do not appear to be present among the expected frames 120, the beat-analyzing block 106 may reevaluate a new series of frames 120 to determine a new set of beat locations and re-extrapolate the beat locations, as discussed in greater detail below. After extrapolating and/or verifying the likely locations of beats in the compressed audio file, the beat-analyzing block 106 may cause these likely beat locations to be stored in the beat database 108 in nonvolatile storage 16 or otherwise to be associated with the metadata of the audio file (block 208) for later use in a beat-matched, DJ-style cross-fading operation.

Figure 16:
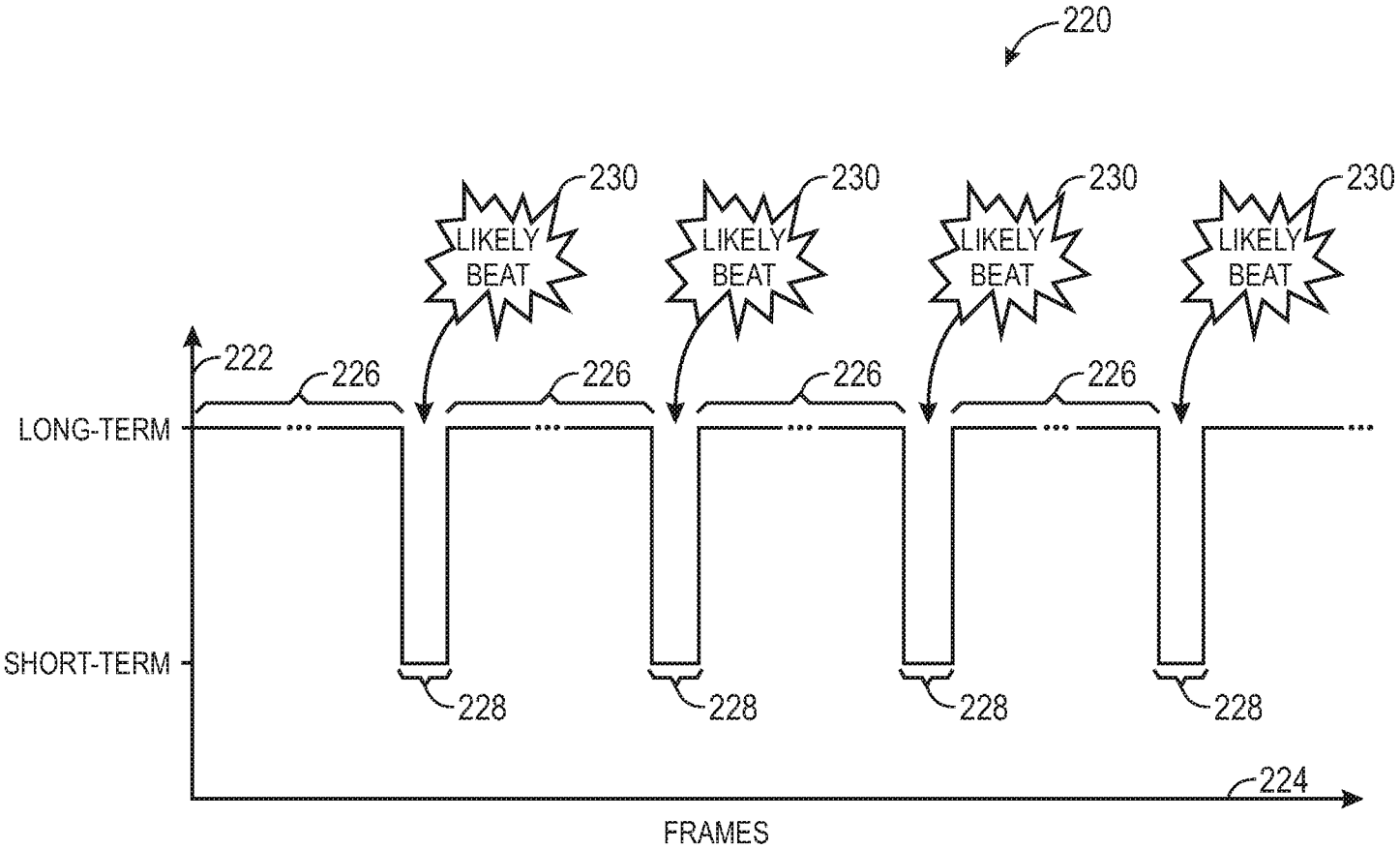
FIG. 16 is a plot modeling a relationship between time window sizes over a series of frames of frequency data and the likely location of beats therein, in accordance with an embodiment.

As discussed above with reference to block 204 of the flowchart 200, the beat-analyzing block 106 running on the processor(s) 12 may consider the periodicity of short-term time windows 122 amid long-term time windows 124 in the series of frames 120. FIG. 16 illustrates one such manner in which likely beats may be determined. Specifically, a plot 220 of FIG. 16 illustrates a periodic pattern of short-term time windows 122 amid long-term time windows 124. The plot 220 includes an ordinate 222 to indicate whether a given frame 120 is a long-term time window 124 or a short-term time window 122. An abscissa 224 of the plot 220 represents a series of frames 120 at increasing points in time. That is, points on the abscissa 224 nearer to the origin represent frames 120 of frequency data 104 nearer to the beginning of the audio file being analyzed.

In the plot 220, non-beat periods 226 may be represented by a series of long-term time windows 124, during which the underlying audio may change relatively slowly over time. These non-beat periods 226 may be punctuated by likely beat periods 228, when the audio information changes relatively quickly over a series of short-term time windows 122. It is during these likely beat periods 228 that the beat-analyzing block 106 may ascertain that a likely beat 230 is present. For example, the beat-analyzing block 106 may assume that a beat is likely to occur in the middle of a series of periodic short-term time windows 122, and thus may select the frame 120 in the center of the likely beat period 228.

While the plot 220 illustrates, by way of example, that likely beats 230 may be found when short-term time windows 122 punctuate long-term time windows 124, it should be understood that the various time window sizes may not neatly form distinct non-beat periods 226 and likely beat periods 228, as illustrated. Under such conditions, the beat-analyzing block 106 may look for a periodic pattern amid the short-term time windows 122 in the series of frames. For example, the beat-analyzing block 106 may seek a series of short-term time windows 122 occurring at a regular interval, even if there are many other series of short-term time windows 122 among the frames 120 of frequency data 104 that occur sporadically.

Figure 17:
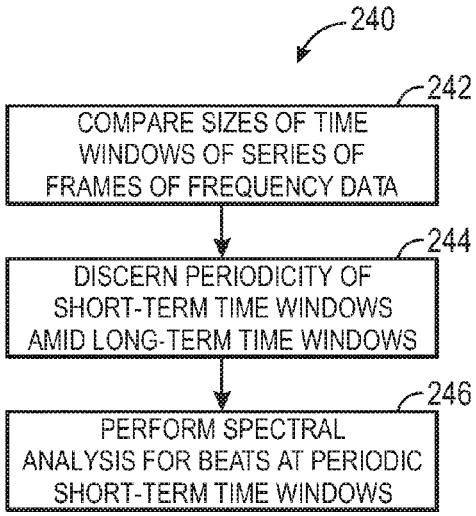
FIGS. 17 and 18 are flowcharts describing embodiments of methods for detecting beats by performing a combined time window and spectral analysis of the frequency data of FIG. 8.

The spectral analysis and time window analysis approaches may be combined in certain embodiments. For example, as illustrated by a flowchart 240 of FIG. 17, the time window analysis approach of FIG. 15 may be used to obtain a first estimate of when beats are occurring, to be refined by a spectral analysis. The flowchart 240 may begin by performing a time window analysis by comparing the sizes of time windows of a series of frames 120 of the frequency data 104 (block 242). Next, the beat-analyzing block 106 may discern a periodicity among the short-term time windows 122 of the frames 120 of frequency data 104 (block 244). The beat-analyzing block 106 may confirm and/or refine more precisely the likely beat location among the several frames 120 of short-term time windows 122 via a spectral analysis (block 246). It should be noted that the embodiment represented by the flowchart 240 may be more accurate than the time window analysis alone, but may consume fewer resources than a spectral analysis of all of the series of frames 120. In other words, the time window analysis approach may isolate general likely locations of a beat among several frames 120, while the spectral analysis may determine precisely which of the frames 120 a beat is likely located.

Figure 18:
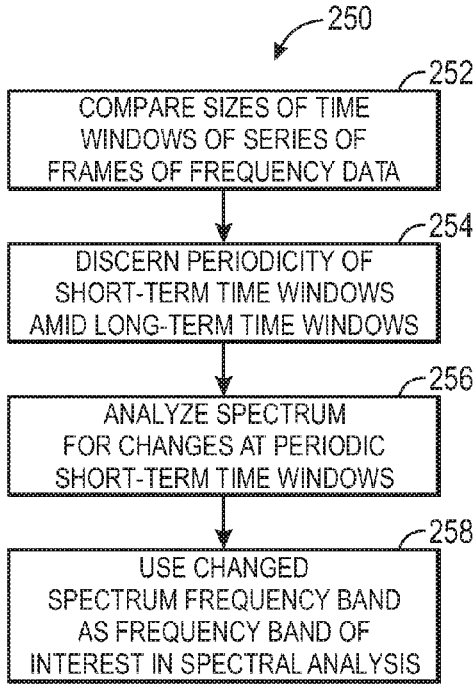

Similarly, a time window analysis of several of the frames 120 of frequency data 104 may be used to identify specific frequencies to serve as a frequency band of interest 166 for use in a subsequent spectral analysis. Such an embodiment is described by a flowchart 250 of FIG. 18, which may begin by performing a time window analysis by comparing the sizes of time windows of a series of frames 120 of the frequency data 104 (block 252). Next, the beat-analyzing block 106 may discern a periodicity among the short-term time windows 122 of the frames 120 of frequency data 104 (block 254). When a likely beat location has been identified based on the time window analysis, the beat-analyzing block 106 may analyze frames 120 around the likely location of the beat for a change in spectrum (block 256).

The spectral changes that may occur at the likely location of the beat as determined by the time window analysis may indicate at which frequencies beats are performed in the audio file being analyzed. For example, in some cases, all of the periodic changes in spectrum may take place in a bass region of frequency, indicating that beats are occurring through bass pulses. Thus, it would be beneficial not to spend resources analyzing other frequency bands in the frames 120 during a spectral analysis, since beats are not expected to occur there. As such, the beat-analyzing block 106 may set the frequency band that is changing as the frequency band of interest 166 in a subsequent spectral analysis of other frames (block 258).

Figure 19:
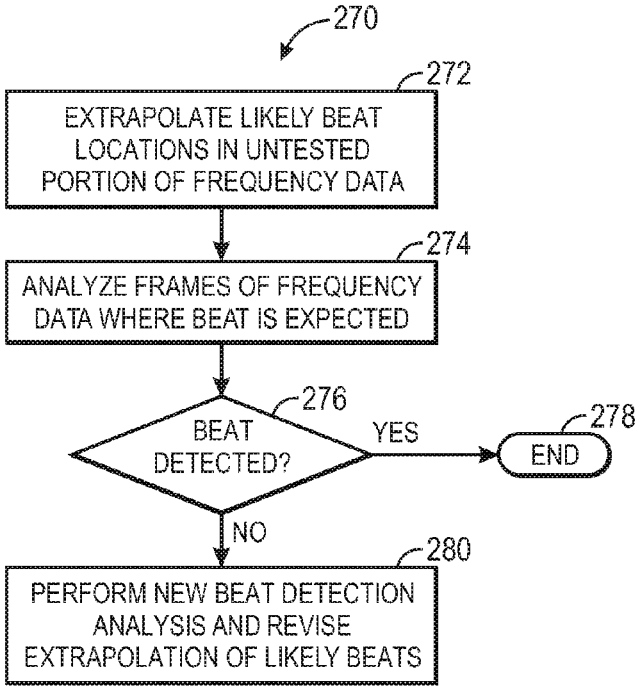
FIG. 19 is a flowchart describing an embodiment of a method for correcting errors in beat detection.

As discussed above, after the beat-analyzing block 106 has extrapolated the likely beat locations based on a time window analysis or spectral analysis, or both, of the frames 120 of frequency data 104, the beat-analyzing block 106 may test whether those beats have been correctly extrapolated. For example, FIG. 19 represents a flowchart 270 for performing such a test, as may take place in block 146 of FIG. 10 or block 206 of FIG. 15. Specifically, the flowchart 270 may begin when the beat-analyzing block 106 extrapolates likely beat locations in untested portions of the frequency data 104 of the audio file being analyzed (block 272). The beat-analyzing block 106 may skip ahead to several frames 120 of the frequency data 104 where a beat is extrapolated to be taking place (block 274). Based on a time window analysis or a spectral analysis, or both, if a beat is detected (decision block 276), the flowchart 270 may end (block 278). The beat-analyzing block 106 thus may determine that the extrapolated beats are most likely correct. In certain embodiments, multiple locations of beats may be tested in this manner before ending.

If a beat is not detected in an extrapolated location (decision block 276), an additional beat detection analysis may take place (block 278). This additional beat detection analysis may involve testing all frames 120 of frequency data 104 of the compressed audio file being tested, or may involve testing only the frames 120 near to where beats have been extrapolated and are expected. After the additional beat detection analysis of block 278, the beat-analyzing block 106 may again extrapolate where beats are likely to occur in the untested portions of frequency data 104. As shown by the flowchart 270, this process may repeat until a one or more beats are detected in untested extrapolated locations.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. An electronic device comprising:

nonvolatile storage configured to store a first compressed audio file;

data processing circuitry configured to unpack the first compressed audio file into frequency data and to estimate locations of beats in the first compressed audio file based at least in part on the frequency data before the frequency data is converted into an audio stream in the time domain; and an audio decoder configured to decode a second compressed audio file into a time domain audio stream while the data processing circuitry unpacks the first compressed audio file into frequency data and estimates the locations of beats in the first compressed audio file.

2. The electronic device of claim 1, wherein the data processing circuitry is configured to detect the locations of the beats in the first compressed audio file based at least in part on a periodic pattern of spectral change over a series of frames of frequency data.

3. The electronic device of claim 1, wherein the data processing circuitry is configured to detect the locations of the beats in the first compressed audio file based at least in part on a periodic pattern of time window sizes of a series of frames of frequency data.

4. The electronic device of claim 1, comprising an audio decoder configured to decode the frequency data of the first compressed audio file unpacked by the data processing circuitry to obtain a time domain audio stream.

5. An article of manufacture comprising:

one or more tangible, machine-readable storage media having non-transitory instructions encoded thereon for execution by a processor, the instructions comprising:

instructions to receive a compressed audio file that encodes an audio stream;

instructions to partially decode the compressed audio file to obtain frames of time window sizes of frequency data representing frequencies present during windows of time of the audio file;

instructions to analyze a first series of the frames of frequency data to determine a first plurality of likely beat locations in the audio stream based at least in part on frequency changes over the first series of the frames of frequency data;

instructions to extrapolate beat locations elsewhere in the audio stream based at least in part on the first plurality of likely beat locations in the audio stream;

instructions to convert the frames of time window sizes of frequency data into time domain audio; and instructions to verify the extrapolated beat locations by analyzing a second series of the frames of frequency data where a beat has been extrapolated and determining whether a likely beat location occurs at that location.

6. The article of manufacture of claim 5, wherein the instructions to analyze the first plurality of the frames of frequency data comprise instructions to identify frequency changes over the first series of the frames of frequency data in a frequency band.

7. The article of manufacture of claim 6, wherein the frequency band comprises a frequency associated with a percussion instrument.

8. The article of manufacture of claim 6, comprising instructions to determine the frequency band by identifying a likely-beat-containing set of frames via a time window analysis and determining what spectral components change in the likely-beat-containing set of frames.

9. The article of manufacture of claim 5, wherein the instructions to analyze the first series of the frames of frequency data comprise instructions to determine a likely beat location when a frequency band of the first series of the frames of frequency data reaches a peak magnitude.

10. A method comprising:

unpacking, using data processing circuitry, a compressed audio file into frames of frequency data representing frequencies present during time windows of the audio file before the frequency data is converted into an audio stream in the time domain;

analyzing, using the data processing circuitry, the frames of frequency data to select a plurality of frames of frequency data representing a frequency band present during short-term time windows of the audio file;

identifying, using the data processing circuitry, likely beat locations in the selected plurality of frames based at least in part on a peak magnitude of a frequency band of interest smaller than the entire frequency band present during the short-term time windows;

converting the frames of frequency data of the time windows of the audio file into time domain audio after identifying the likely beat locations; and crossfading the audio file with another audio file using the likely beat locations.

11. The method of claim 10, wherein the likely beat locations are identified based at least in part on a periodic occurrence of the plurality of frames of frequency data representing the short-term time windows.

12. The method of claim 10, wherein the likely beat locations are identified based at least in part on a periodic occurrence of the plurality of frames of frequency data representing the short-term time windows punctuating frames of frequency data having relatively long-term time windows.

13. The method of claim 10, comprising identifying a specific frame of frequency data as a likely beat location by identifying a likely-beat-containing set of frames and selecting a centermost frame from among the likely-beat-containing set of frames.

14. A non-transitory machine readable medium providing instructions which when executed by data processing circuitry cause the data processing circuitry to perform a method of processing data, the method comprising:

unpacking, using data processing circuitry, a compressed audio file into frames of frequency data representing frequencies present during time windows of the audio file before the frequency data is converted into an audio stream in the time domain;

analyzing, using the data processing circuitry, the frames of frequency data to select a plurality of frames of frequency data representing a frequency band present during short-term time windows of the audio file;

identifying, using the data processing circuitry, likely beat locations in the selected plurality of frames based at least in part on a peak magnitude of a frequency band of interest smaller than the entire frequency band present during the short-term time windows;

converting the frames of frequency data of the time windows of the audio file into time domain audio after identifying the likely beat locations; and crossfading the audio file with another audio file using the likely beat locations.

15. The medium of claim 14, wherein the likely beat locations are identified based at least in part on a periodic occurrence of the plurality of frames of frequency data representing the short-term time windows.

16. The medium of claim 14, wherein the likely beat locations are identified based at least in part on a periodic occurrence of the plurality of frames of frequency data representing the short-term time windows punctuating frames of frequency data having relatively long-term time windows.

17. The medium of claim 14, comprising identifying a specific frame of frequency data as a likely beat location by identifying a likely-beat-containing set of frames and selecting a centermost frame from among the likely-beat-containing set of frames.

* * * * *